US011655655B2

(12) United States Patent
Chen et al.

(10) Patent No.: US 11,655,655 B2
(45) Date of Patent: May 23, 2023

(54) DOOR LOCK DEVICE

(71) Applicant: Thase Enterprise Co., Ltd., New Taipei (TW)

(72) Inventors: Jui-Ming Chen, New Taipei (TW); Ching-Tien Lin, New Taipei (TW)

(73) Assignee: THASE ENTERPRISE CO., LTD., New Taipei (TW)

( * ) Notice: Subject to any disclaimer, the term of this patent is extended or adjusted under 35 U.S.C. 154(b) by 258 days.

(21) Appl. No.: 16/936,037

(22) Filed: Jul. 22, 2020

(65) Prior Publication Data

US 2021/0277687 A1 Sep. 9, 2021

(30) Foreign Application Priority Data

Mar. 5, 2020 (TW) ..... 109202437

(51) Int. Cl.
*E05B 65/10* (2006.01)

(52) U.S. Cl.
CPC ..... *E05B 65/1073* (2013.01); *E05B 65/1053* (2013.01)

(58) Field of Classification Search
CPC ..... Y10T 292/0908; Y10T 292/0909; Y10T 292/091; E05B 65/1073; E05B 65/1053; E05B 65/10; E05B 65/1046; Y10S 292/65
See application file for complete search history.

(56) References Cited

U.S. PATENT DOCUMENTS 975,456 A * 11/1910 Prevost ..... E05B 65/1073 292/93
3,869,159 A * 3/1975 Eads ..... E05C 1/14 70/462
4,101,153 A * 7/1978 Dozier ..... E05B 1/0053 70/92
4,986,583 A * 1/1991 Campbell ..... E05B 65/104 292/336.3
RE36,209 E * 5/1999 Walls ..... E05B 63/0069 292/336.3
6,293,598 B1 * 9/2001 Rusiana ..... E05C 1/14 70/91
2004/0124639 A1 * 7/2004 Lin ..... E05B 65/1073 292/92
2004/0227351 A1 * 11/2004 Lin ..... E05B 65/1006 292/92
2006/0010942 A1 * 1/2006 Toloday ..... E05B 63/0065 70/210

(Continued)

FOREIGN PATENT DOCUMENTS

DE 102013000285 A1 * 12/2013 ..... E05B 47/00
EP 3219886 A1 * 9/2017 ..... E05B 47/0012

(Continued)

OTHER PUBLICATIONS

Espacenet machine translation of DE 102013000285 A1 performed Oct. 18, 2022 (Year: 2013).*

*Primary Examiner* — Kristina R Fulton
*Assistant Examiner* — Steven A Tullia
(74) *Attorney, Agent, or Firm* — Ditthavong, Steiner & Mlotkowski

(57) ABSTRACT

A door lock device is provided and includes a lock assembly and an operation assembly interlocked with the lock assembly so as to bury the lock assembly in a door frame, thereby protecting the lock assembly from being damaged or stolen.

9 Claims, 10 Drawing Sheets

(56) References Cited

U.S. PATENT DOCUMENTS

| | | | | |
|---|---|---|---|---|
| 2008/0106104 | A1* | 5/2008 | Lin | E05B 63/0065 292/92 |
| 2015/0252592 | A1* | 9/2015 | Tien | E05B 65/10 70/92 |
| 2016/0017641 | A1* | 1/2016 | Lin | E05B 65/104 292/92 |
| 2016/0312503 | A1* | 10/2016 | Shah | E05C 1/14 |
| 2017/0081883 | A1* | 3/2017 | Lin | E05B 65/1093 |

FOREIGN PATENT DOCUMENTS

| | | | | | |
|---|---|---|---|---|---|
| FR | 2861789 | A1 * | 5/2005 | | E05B 63/04 |
| GB | 2323405 | A * | 9/1998 | | E05B 65/1053 |
| GB | 2459493 | A * | 10/2009 | | E05B 65/1066 |
| GB | 2529530 | A * | 2/2016 | | E05B 17/20 |
| GB | 2541023 | A * | 2/2017 | | E05B 65/10 |
| WO | WO-2015007763 | A1 * | 1/2015 | | E05B 65/1053 |

* cited by examiner

DOOR LOCK DEVICE

CROSS-REFERENCE TO RELATED APPLICATIONS

This application claims priority to Taiwan Application Serial No. 109202437, filed on Mar. 5, 2020. The entirety of the above-mentioned patent application is hereby incorporated by reference herein and made a part of this specification.

BACKGROUND

1. Technical Field

The present disclosure relates to locks, and more particularly, to a door lock device for a fire door.

2. Description of Related Art

Conventionally, an emergency exit door lock is unlocked by pushing so as to open the door for an escape route.

However, since the lock is generally arranged outside the door with its lock head extending or retracting at a door position, it is easily stolen or damaged during long-term use.

Therefore, how to overcome the above-described drawbacks of the prior art has become an urgent issue in the art.

SUMMARY

In view of the above-described drawbacks, the present disclosure provides a door lock device, which comprises: a lock assembly comprising a driving member, an acting member connected to the driving member, an active member cooperating with the acting member for operation, and a main lock member interlocked with the active member, wherein the driving member drives the acting member to swing and the acting member touches the active member to displace the active member and synchronously displace the main lock member; and an operation assembly interlocked with the driving member of the lock assembly.

In an embodiment, the lock assembly further comprises a housing structure configured with the main lock member and the active member, and wherein the main lock member is displaced relative to the housing structure to extend out of or retract into the housing structure and the active member is displaceably disposed on the housing structure and securely connected to the main lock member. For example, the lock assembly further comprises a carrier structure fastened onto the housing structure, and wherein the main lock member is connected to the carrier structure in a manner that the main lock member is displaceable relative to the carrier structure.

In an embodiment, the driving member is a shaft body, wherein one end portion of the driving member is formed with a sliding portion displaceably connected to the operation assembly and another end portion of the driving member is securely connected to the acting member to drive the acting member to swing.

In an embodiment, the acting member is of a spoon shape and has a spoon body engaged on the driving member and a handle portion connected to the spoon body to swing about the driving member as an axis.

In an embodiment, the active member has a displacement portion displaceable toward a certain direction, a force bearing portion disposed on the displacement portion, and a fastening portion disposed on the displacement portion and securely connected to the main lock member, wherein the acting member hooks and causes the force bearing portion to displace and enables the displacement portion to displace linearly and to drive the fastening portion, allowing the fastening portion to displace together with the main lock member.

In an embodiment, the operation assembly comprises at least one acting mechanism and an interlocking mechanism interlocking the acting mechanism and the driving member. For example, the acting mechanism has a rotating member, an actuating member and a fastening member, wherein the rotating member has a shaft portion, with a first arm portion and a second arm portion connected to different sides of the shaft portion, the shaft portion being connected to the fastening member, the first arm portion being connected to the actuating member, and the second arm portion being connected to the interlocking mechanism. In an embodiment, the interlocking mechanism has an interlocking member connected to the acting mechanism and an inactive member connected to the interlocking member, wherein one side of the inactive member is connected to the interlocking member and another side of the inactive member is displaceably connected to the driving member.

In an embodiment, the door lock device further comprises a handle assembly encapsulating the operation assembly.

Therefore, the door lock device according to the present disclosure allows the lock assembly to be buried in a door frame through cooperation of the driving member, the acting member and the active member, thereby protecting the lock assembly from being damaged or stolen.

BRIEF DESCRIPTION OF THE DRAWINGS

FIGS. 3A' and 3B' are schematic partial rear views of a door lock device in operation according to the present disclosure.

DETAILED DESCRIPTION

The following illustrative embodiments are provided to illustrate the present disclosure, these and other advantages and effects can be apparent to those in the art after reading this specification.

It should be noted that all the drawings are not intended to limit the present disclosure. Various modifications and variations can be made without departing from the spirit of the present disclosure. Further, terms such as "up," "down," "front," "rear," "left," "right," "a," etc., are merely for illustrative purposes and should not be construed to limit the scope of the present disclosure.

Figure 1A:
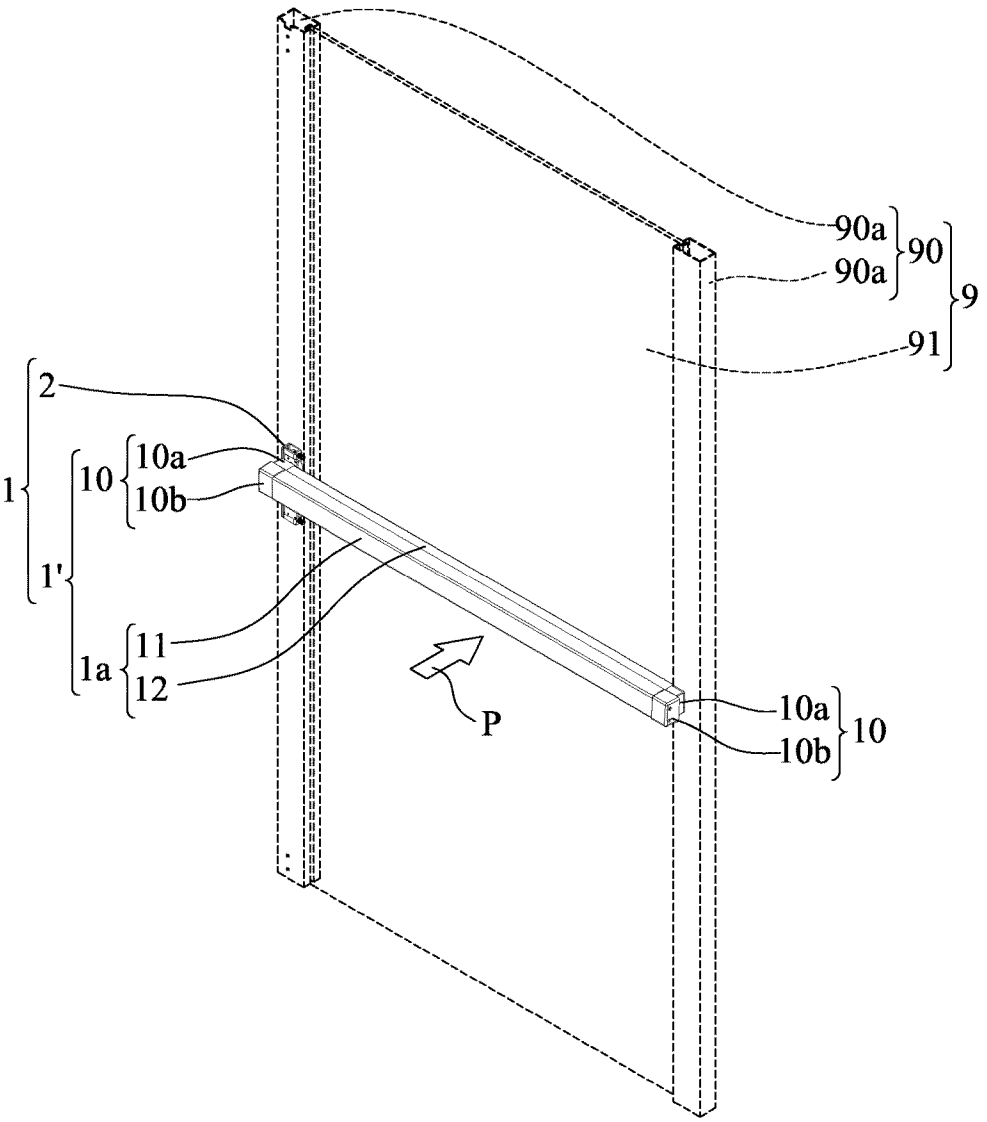
FIG. 1A is a schematic front perspective view of a door lock device in use according to the present disclosure.
Figure 1B:
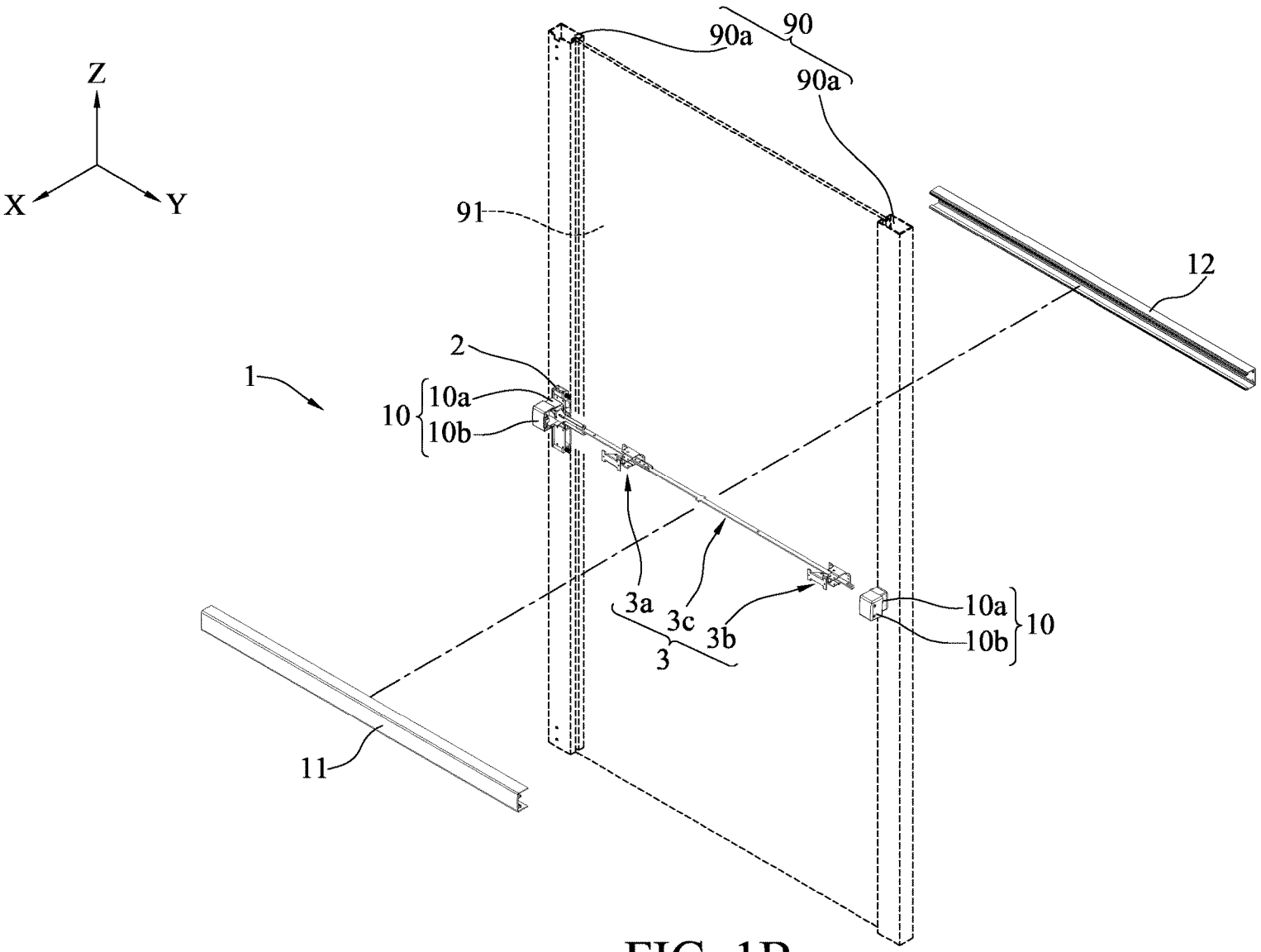
FIG. 1B is a schematic partially exploded perspective view of FIG. 1A.

FIGS. 1A and 1B are schematic views illustrating application of a door lock device 1 to a door structure 9 according to the present disclosure. As shown in FIGS. 1A and 1B, the door structure 9 comprises a set of a door frame 90 corresponding in size to a door opening and a door plate 91 attached to the door frame 90. The door lock device 1 is, for example, a headless lock box type fireproof door lock, which includes a lock assembly 2 buried in the door frame 90, an operation assembly 3 disposed outside the door frame 90 and the door plate 91 and interlocked with the lock assembly 2, and a handle assembly 1' encapsulating the operation assembly 3.

In an embodiment, a front or rear direction such as an arrow direction X is defined along an entry or exit direction of the door, a left or right direction such as an arrow direction Y is defined along a direction of a short side of the door plate 91, and an up or down direction such as an arrow direction Z is defined along a direction of a height of the door plate 91. It should be noted that the arrow directions X, Y and Z are used for illustrative purposes and not intended to limit the present disclosure.

Further, the door plate 91 is a rectangular plate body. The door frame 90 comprises vertical hollow rod bodies 90*a* arranged at the left and right sides of the door plate 91, respectively. The lock assembly 2 is buried in one of the rod bodies 90*a*, and the operation assembly 3 is disposed on the two rod bodies 90*a* and across the door plate 91 (approximately at the middle of the door plate 91).

Furthermore, the handle assembly 1' is disposed at the front side of the door plate 91. The handle assembly 1' comprises a handle structure 1*a* and a plurality of fastening structures 10 arranged on outer surfaces of the two rod bodies 90*a* and engaged with the handle structure 1*a*. For example, the handle structure 1*a* comprises a handle portion 11 and a cover portion 12 cooperating with one another. The fastening structure 10 has a positioning portion 10*a* and a base portion 10*b* connected to the positioning portion 10*a*. The fastening structures 10 are fastened to the door frame 90 through the positioning portions 10*a*, the cover portion 12 is securely connected to the positioning portions 10*a*, and the handle portion 11 is displaceably engaged to the base portion 10*b* so as to displace along the front or rear direction (e.g., the arrow direction X) relative to the base portion 10*b*. The handle portion 11 and the cover portion 12 cooperatively form a long hollow tube body corresponding to the operation assembly 3, and the positioning portion 10*a* and the base portion 10*b* are combined into a groove body with an opening of the groove body correspondingly receiving an end portion of the long hollow tube body. The handle assembly 1' has a lot of specific parts, which are well known in the art and detailed description thereof are omitted herein.

The operation assembly 3 comprises at least one acting mechanism 3*a*, 3*b* and an interlocking mechanism 3*c* interlocked with the acting mechanism 3*a*, 3*b*.

Figure 2A:
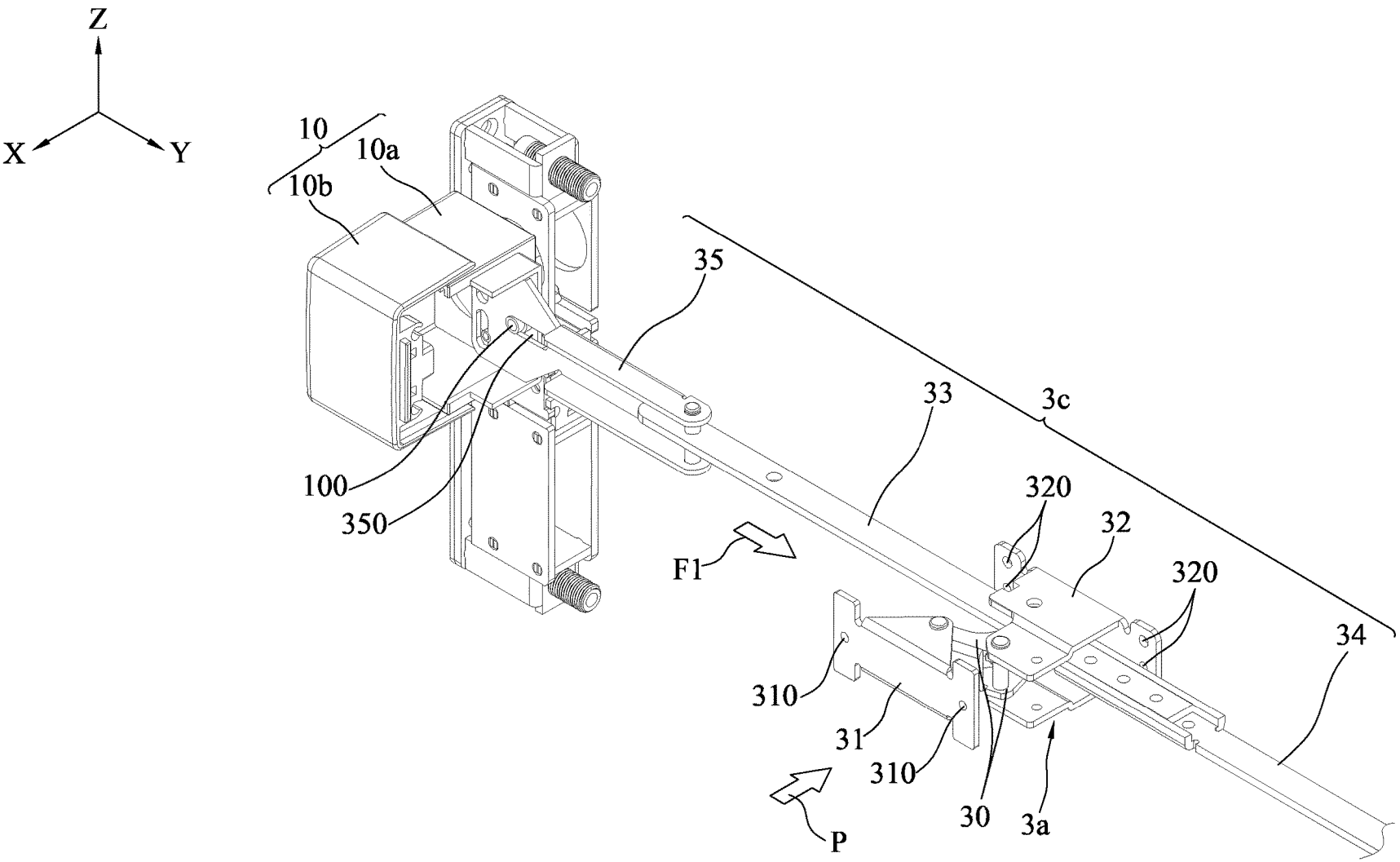
FIG. 2A is a schematic partial front perspective view of a door lock device according to the present disclosure.
Figure 2B:
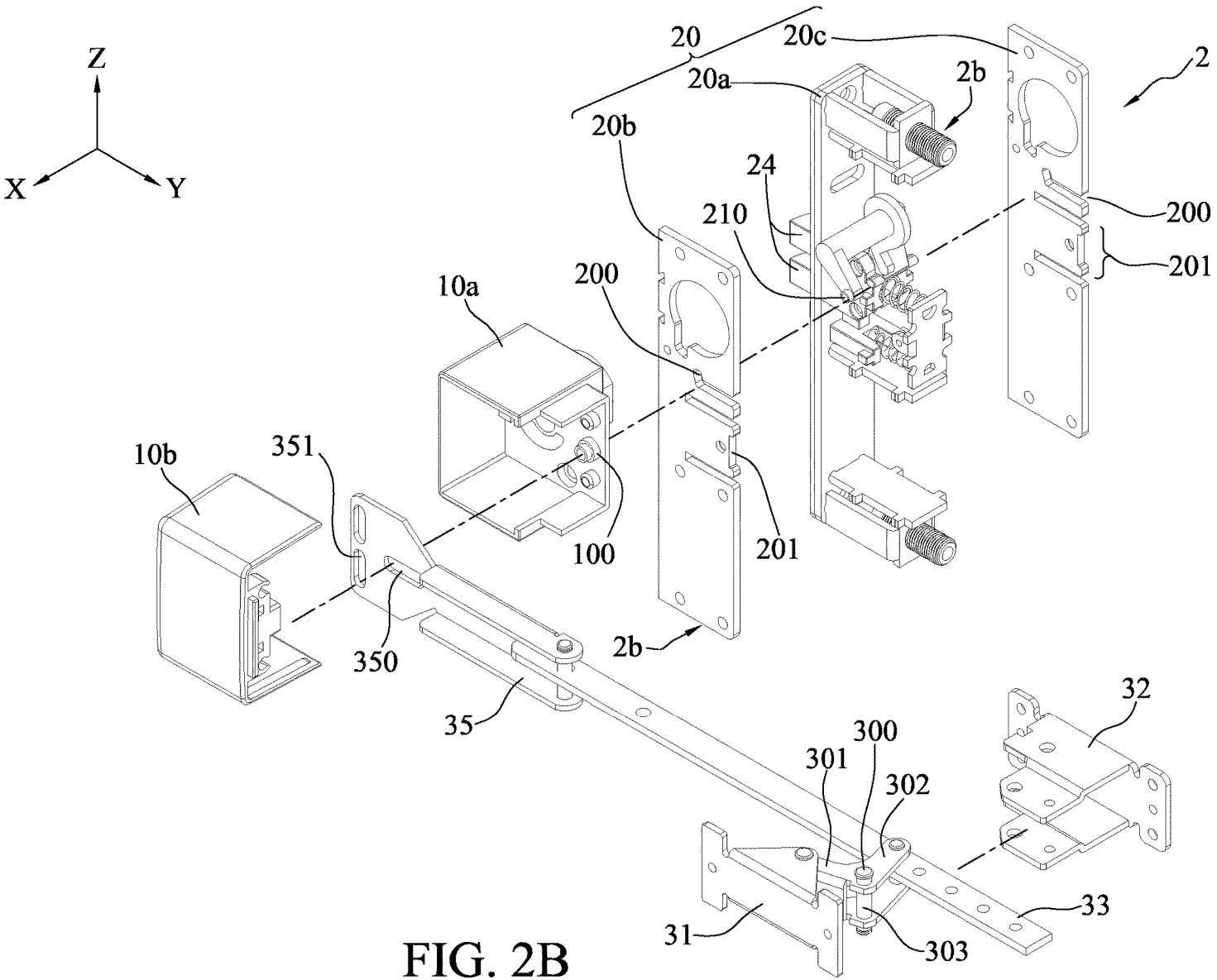
FIG. 2B is a schematic exploded perspective view of FIG. 2A.

In an embodiment, the operation assembly 3 is substantially arranged along the width of the door plate 91 (e.g., in the arrow direction Y) and has two sets of acting mechanisms 3*a*, 3*b* (as shown FIG. 1B). As shown in FIGS. 2A and 2B, a set of the acting mechanism 3*a* has a rotating member 30, an actuating member 31 connected to the handle portion 11 through such as fastening holes 310, and a fastening member 32 connected to the cover portion 12 through such as fastening holes 320. The rotating member 30 has a shaft portion 300 such as a shaft member 303, and a first arm portion 301 and a second arm portion 302 connected to different sides of the shaft portion 300. As such, the shaft portion 300 is connected to the fastening member 32, the first arm portion 301 is connected to the actuating member 31, and the second arm portion 302 is connected to the interlocking mechanism 3*c*. For example, the rotating member 30 is substantially of a boomerang shape and the fastening member 32 has a pinch shape allowing the interlocking mechanism 3*c* to pass therethrough. The set of the acting mechanism 3*b* has substantially the same configuration.

The interlocking mechanism 3*c* has an interlocking member 33 connected to the acting mechanism 3*a* (the second arm portion 302 thereof), an inactive member 35 connected to one end of the interlocking member 33, and a connecting member 34 connecting the acting mechanism 3*b* (the second arm portion 302 thereof) and the other end of the interlocking member 33. Therefore, the second arm portions 302 of the two sets of the acting mechanisms 3*a*, 3*b* are connected to the interlocking member 33 and the connecting member 34, respectively, so as to interlock the acting mechanisms 3*a*, 3*b*. For example, the interlocking member 33 and the connecting member 34 are both rod bodies, the right side of the inactive member 35 is connected to the interlocking member 33 and the left side of the inactive member 35 is displaceably disposed on the positioning portion 10*a*. The inactive member 35 has a first groove 350 formed on the left side thereof and the positioning portion 10*a* has a bump 100 corresponding to the first groove 350 so as to allow the inactive member 35 to displace relative to the positioning portion 10*a*.

Figure 2C:
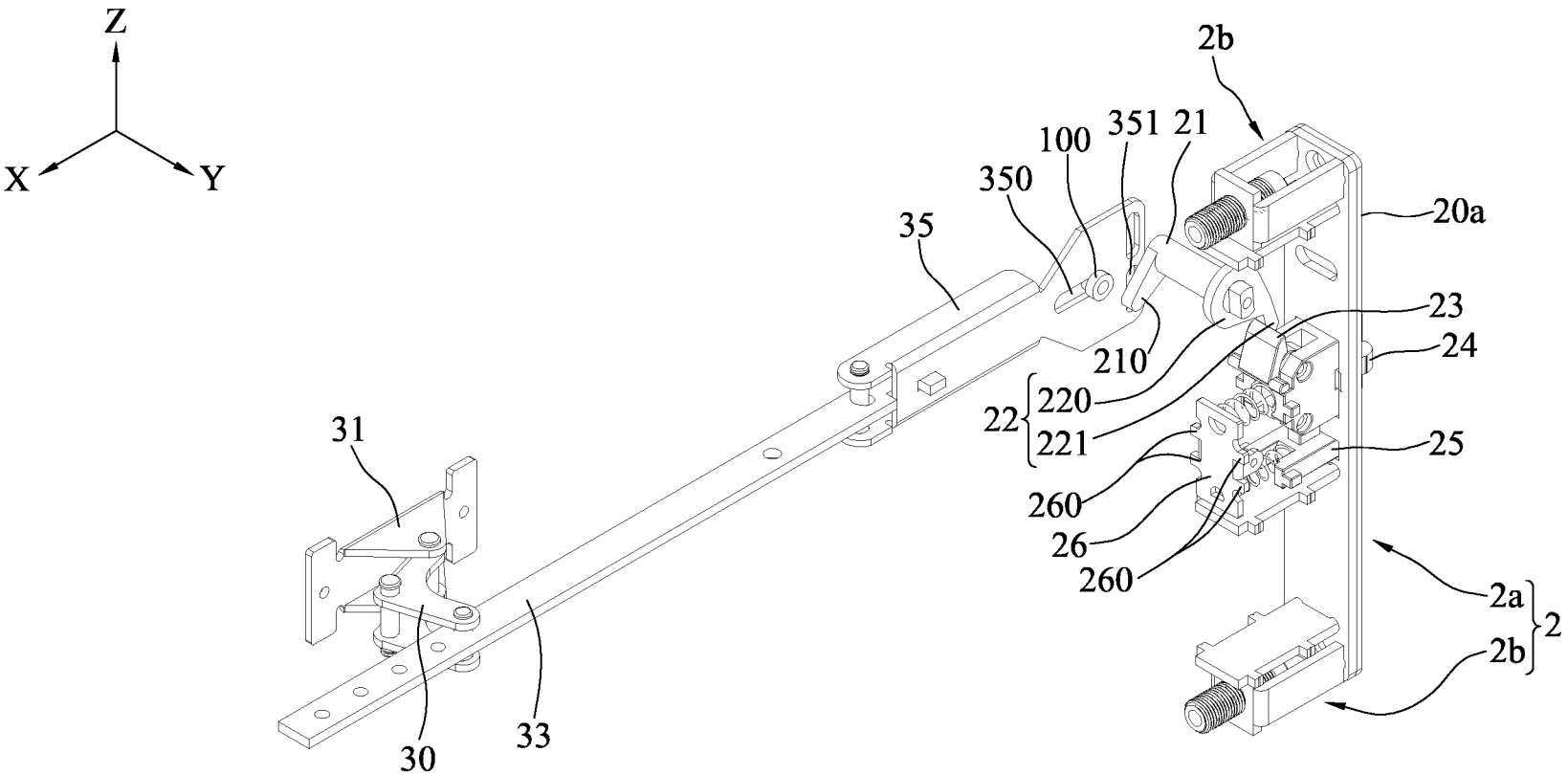
FIG. 2C is a schematic partial rear perspective view of a door lock device according to the present disclosure.

As shown in FIGS. 2B and 2C, the lock assembly 2 comprises a lock body 2*a* disposed inside the door frame 90 and at least one assembling structure 2*b* for fastening the lock body 2*a* inside the door frame 90. The lock body 2*a* has a housing structure 20, a driving member 21 connected to the inactive member 35, an acting member 22 connected to the driving member 21, an active member 23 arranged on the housing structure 20, a main lock member 24 arranged on the housing structure 20, an auxiliary lock member 25 arranged on the housing structure 20, and a carrier structure 26 fastened on the housing structure 20 and connected to the main lock member 24 and the auxiliary lock member 25 in a manner that the main lock member 24 and the auxiliary lock member 25 are displaceable relative to the carrier structure 26.

In an embodiment, the housing structure 20 has a main housing 20*a* positioned on the left side thereof and configured with the main lock member 24 and the auxiliary lock member 25, and a first plate body 20*b* and a second plate body 20*c* disposed on the front and rear sides of the main housing 20*a* and configured with the active member 23. The driving member 21 is a shaft body, which passes through the first plate body 20*b* and extends into the positioning portion 10*a*. As such, two ends of the driving member 21 are connected to the inactive member 35 and the acting member 22, respectively. For example, one end portion of the driving member 21 has a sliding portion 210 (as shown in FIG. 2B) extending therefrom and displaceably connected to the inactive member 35 (the second groove 351 of the inactive member 35), and the other end portion of the driving member 21 is securely connected to the acting member 22 so that the inactive member 35 can drive the acting member 22 to swing. The acting member 22 is of a spoon shape, which has a spoon body 220 engaged on the end portion of the driving member 21 so that a handle portion 221 of the acting member 22 can swing about the end portion of the driving member 21 as an axis.

Figure 2D:
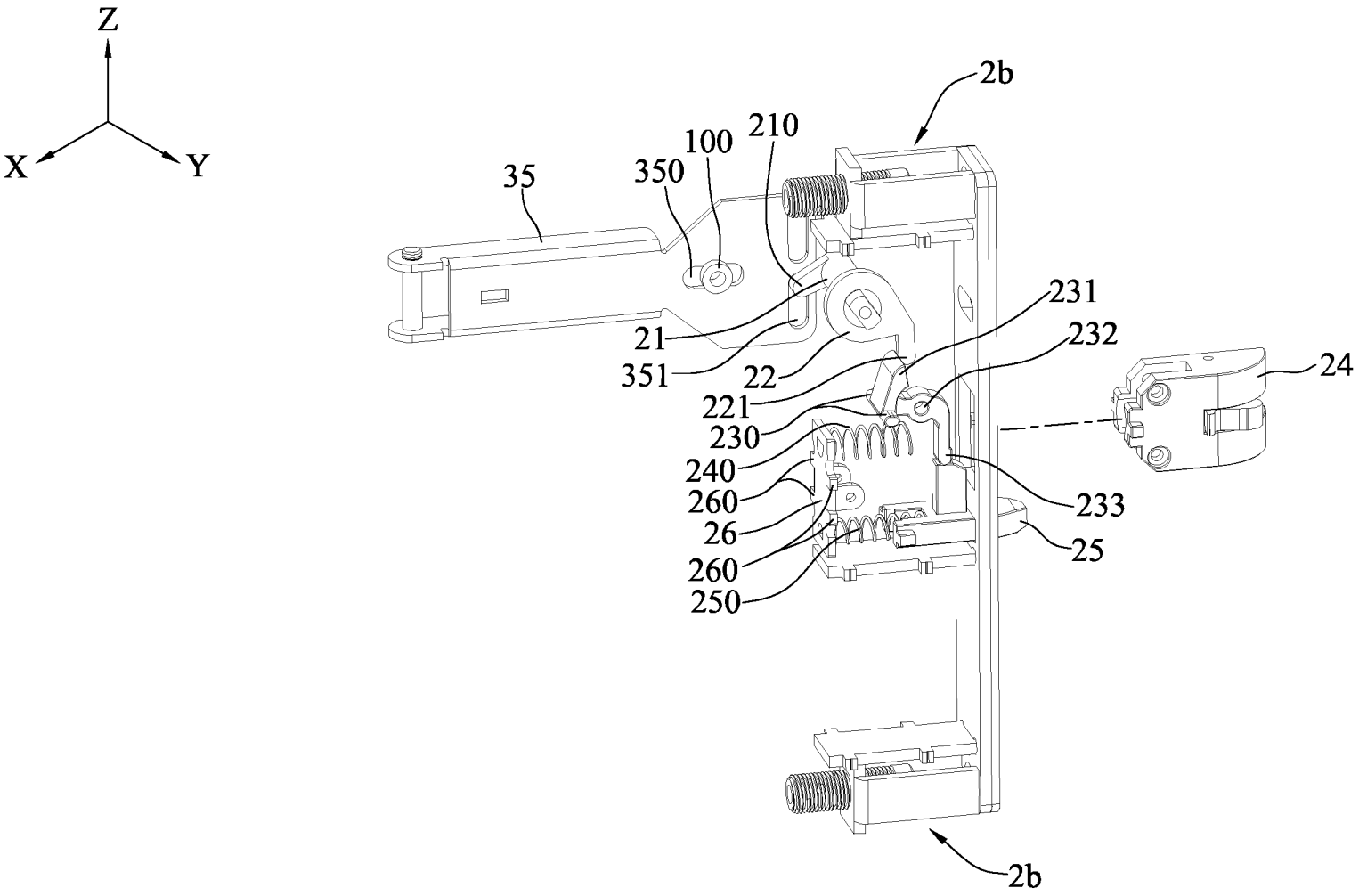
FIG. 2D is a schematic partially exploded perspective view of FIG. 2C.

Further, the active member 23 is displaceably disposed on the first plate body 20*b* and the second plate body 20*c* and securely connected to the main lock member 24. As shown in FIG. 2D, the active member 23 has a displacement portion 230 displaceably disposed on the first plate body 20*b* and the second plate body 20*c* (e.g., through sliding grooves 200 of FIG. 2B), a force bearing portion 231 disposed on the displacement portion 230, a fastening portion 232 disposed on the displacement portion 230 and securely connected to the main lock member 24, and a driving portion 233 interlocked with the auxiliary lock member 25. As such, when swinging, the handle portion 221 of the acting member 22 hooks and causes the force bearing portion 231 to displace and hence causes the displacement portion 230 to displace linearly along the sliding grooves 200, thereby allowing the fastening portion 232 to displace together with the main lock member 24. Meanwhile, the driving portion 233 drives the auxiliary lock member 25 to displace.

Further, the carrier structure 26 is a sheet body, which is engaged with engaging grooves 201 of the first plate body 20*b* and the second plate body 20*c* through a plurality of engaging bars 260 so as to be fastened onto the housing structure 20, and connected to the main lock member 24 and the auxiliary lock member 25 through a plurality of elastic elements 240, 250 such as springs, respectively. As such, the main lock member 24 and the auxiliary lock member 25 can extend out of or retract into the main housing 20*a*.

Further, the assembling structures 2*b* are fastened onto the main housing 20*a* of the housing structure 20 so as to be connected to the door frame 90. There is no limit on the type of the assembling structures 2*b*.

Figure 3A:
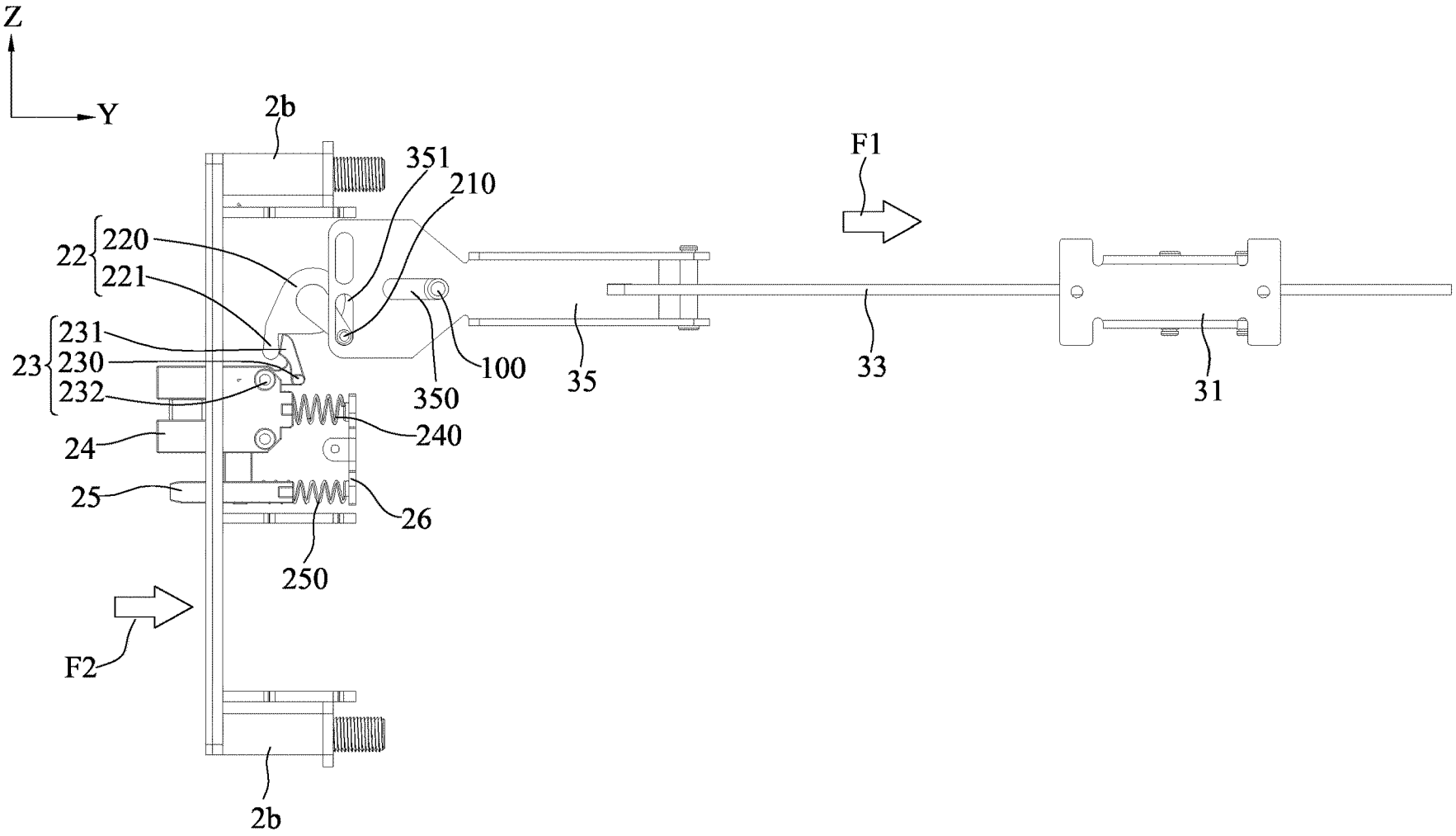
FIGS. 3A and 3B are schematic partial front views of a door lock device in operation according to the present disclosure.
Figure 3A:
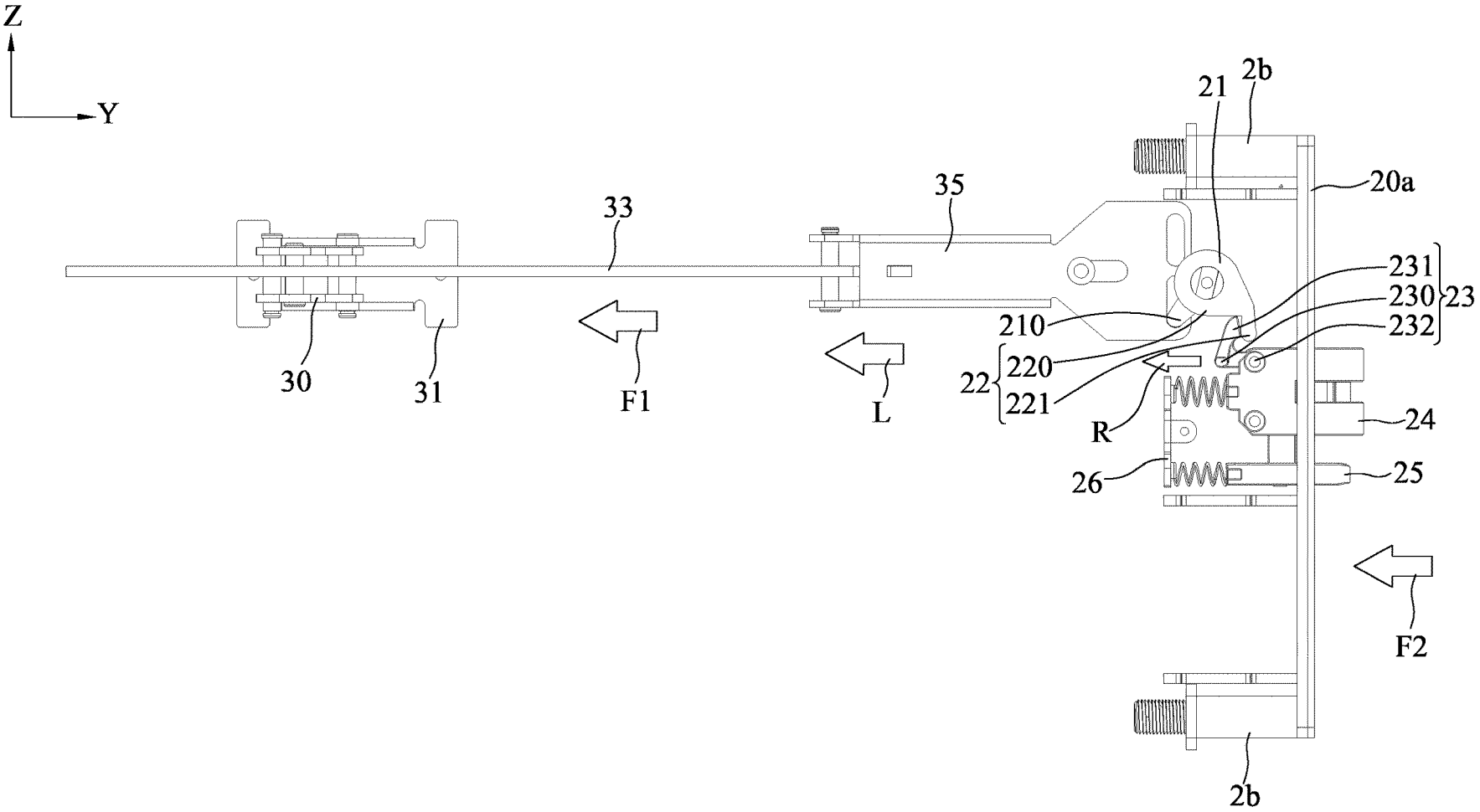
Figure 3B:
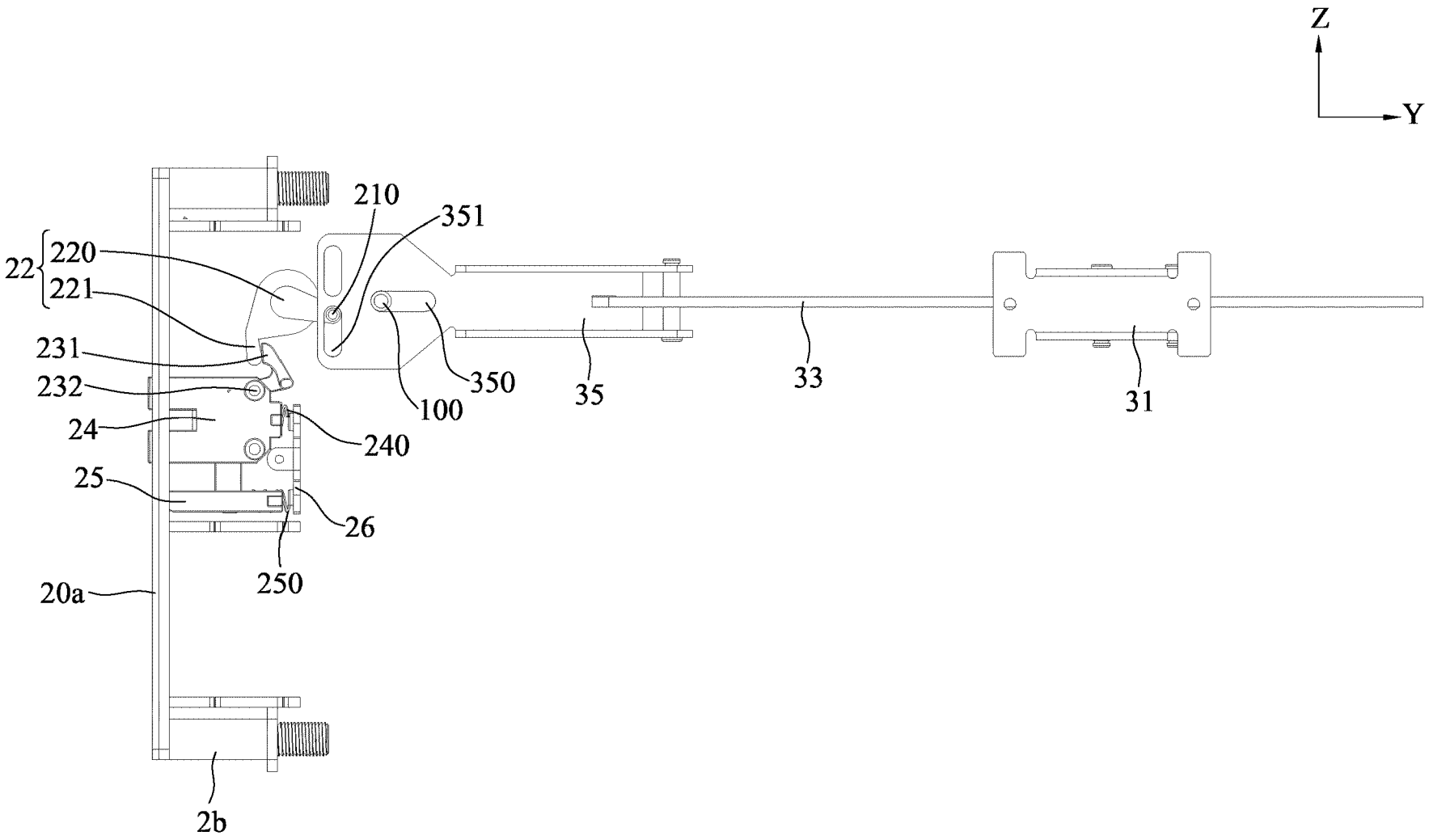
Figure 3B:
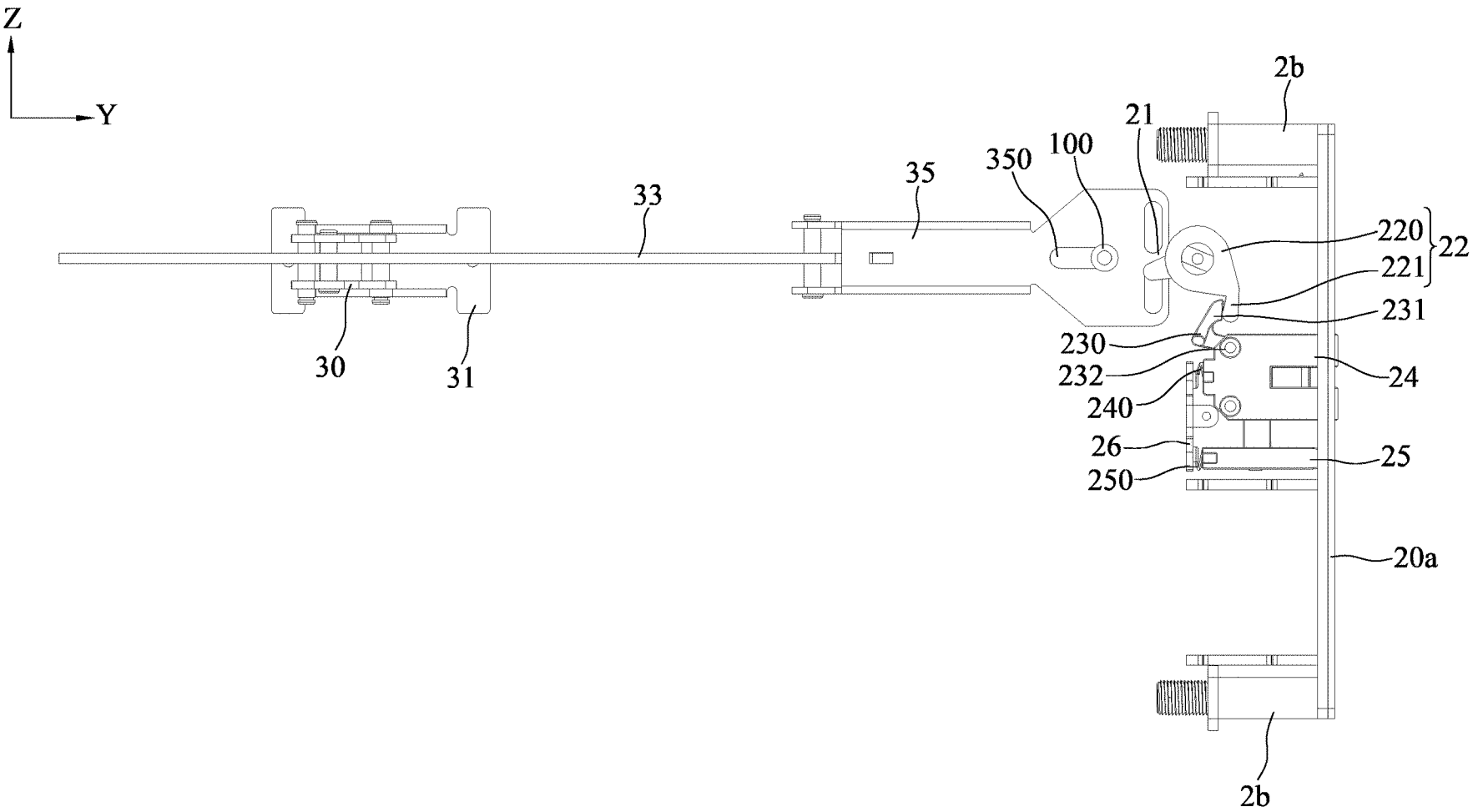

FIGS. 3A and 3B illustrate operation of the door lock device 1 according to the present disclosure. As shown in FIG. 3A, the user pushes the handle portion 11 with a pushing force P (as shown in FIG. 1A). As such, the handle portion 11 pushes the actuating members 31 of the acting mechanisms 3*a*, 3*b* (as shown in FIGS. 2A and 2B) so as to drive the rotating members 30 to rotate. Therefore, the second arm portions 302 drive the interlocking member 33 and the connecting member 34 to moves linearly in a direction away from the lock assembly 2 (e.g., in an acting direction F1 of FIG. 3A), thus causing the inactive member 35 to move in a direction away from the main housing 20*a* (as shown in FIGS. 3A and 3B).

At this point, the sliding portion 210 of the driving member 21 is pushed to move upward along the second groove 351, thereby driving the spoon body 220 of the acting member 22 to swing. Hence, the handle portion 221 of the acting member 22 swings in a direction away from the main housing 20*a* (in an acting direction R of FIG. 3A') so as to hook and cause the force bearing portion 231 of the active member 23 to displace (as shown in FIG. 3B'). Accordingly, the displacement portion 230 displaces linearly in a direction away from the main housing 20*a* along the sliding grooves 200 of the first plate body 20*b* and the second plate body 20*c* (in an acting direction L of FIG. 3A'), thus causing the fastening portion 232 to displace. Therefore, the main lock member 24 and the auxiliary lock member 25 compress the elastic elements 240, 250 in a direction toward the inside of the housing structure 20 (in an acting direction F2 of FIGS. 3A and 3A') and retract into the housing structure 20.

After the user releases the handle portion 11, the operating assembly 3 returns to the original position (as shown in FIG. 3A) so as to cause the lock assembly 2 to return to original shape (as shown in FIG. 3A).

Therefore, the door lock device 1 of the present disclosure allows the lock assembly 2 to be buried in the door frame 90 through cooperation of the driving member 21, the acting member 22 and the active member 23, thereby protecting the lock assembly 2 from being damaged or stolen.

The above-described descriptions of the detailed embodiments are to illustrate the preferred implementation according to the present disclosure, and it is not to limit the scope of the present disclosure. Accordingly, all modifications and variations completed by those with ordinary skill in the art should fall within the scope of the present disclosure defined by the appended claims.

What is claimed is:

1. A door lock device, comprising:

a lock assembly, comprising:

a housing structure;

a driving member of a shaft body;

an acting member directly connected to the driving member, wherein the acting member is of a spoon shape, has a spoon body directly engaged on the driving member, and has a handle portion connected to the spoon body to rotate with the driving member around a common axis of rotation thereof;

an active member arranged on the housing structure and cooperating with the acting member for operation, wherein the active member has a force bearing portion;

a main lock member arranged on the housing structure and directly interlocked with the active member; and a carrier structure fastened on the housing structure and connected to the main lock member via at least one elastic element, wherein the driving member is configured to rotate perpendicularly to a long axis of the main lock member, wherein when the housing structure receives a force, the driving member drives the acting member to swing away from a main housing of the housing structure and to drive the handle portion of the acting member to hook and touch the force bearing portion of the active member so as to displace the active member and synchronously displace the main lock member; and an operation assembly interlocked with the driving member of the lock assembly.

2. The door lock device of claim 1, wherein the lock assembly further comprises a housing structure configured with the main lock member and the active member, and wherein the main lock member is displaced relative to the housing structure to extend out of or retract into the housing structure, and the active member is displaceably disposed on the housing structure and securely connected to the main lock member.

3. The door lock device of claim 2, wherein the lock assembly further comprises a carrier structure fastened onto the housing structure, and wherein the main lock member is connected to the carrier structure in a manner that the main lock member is displaceable relative to the carrier structure.

4. The door lock device of claim 1, wherein one end portion of the driving member is formed with a sliding portion displaceably connected to the operation assembly and another end portion of the driving member is securely connected to the acting member to drive the acting member to swing.

5. The door lock device of claim 1, wherein the active member further has a displacement portion displaceable toward a direction, the force bearing portion disposed on the displacement portion, and a fastening portion disposed on the displacement portion and securely connected to the main lock member, and wherein the acting member hooks and causes the force bearing portion to displace and enables the displacement portion to displace linearly and to drive the fastening portion, allowing the fastening portion to displace together with the main lock member.

6. The door lock device of claim 1, wherein the operation assembly comprises at least one acting mechanism and an interlocking mechanism interlocking the acting mechanism and the driving member.

7. The door lock device of claim 6, wherein the acting mechanism has a rotating member, an actuating member and a fastening member, and wherein the rotating member has a shaft portion, with a first arm portion and a second arm portion connected to different sides of the shaft portion, the shaft portion being connected to the fastening member, the first arm portion being connected to the actuating member, and the second arm portion being connected to the interlocking mechanism.

8. The door lock device of claim 6, wherein the interlocking mechanism has an interlocking member connected to the acting mechanism and an inactive member connected to the interlocking member, and wherein one side of the inactive member is connected to the interlocking member and another side of the inactive member is displaceably connected to the driving member.

9. The door lock device of claim 1, further comprising a handle assembly encapsulating the operation assembly.

* * * * *